US005646633A

United States Patent [19]

Dahlberg

[11] Patent Number: 5,646,633

[45] Date of Patent: Jul. 8, 1997

[54] MICROSTRIP ANTENNA HAVING A PLURALITY OF BROKEN LOOPS

[75] Inventor: Scott E. Dahlberg, St. Charles County, Mo.

[73] Assignee: McDonnell Douglas Corporation, St. Louis, Mo.

[21] Appl. No.: 417,663

[22] Filed: Apr. 5, 1995

[51] Int. Cl.[6] ..... H01Q 1/38

[52] U.S. Cl. ..... 343/700 MS; 343/742; 343/846; 343/895

[58] Field of Search ..... 343/700 MS, 895, 343/846, 741, 742, 743; H01Q 1/36

[56] References Cited

U.S. PATENT DOCUMENTS

| | | | |
|---|---|---|---|
| 3,019,439 | 1/1962 | Reis et al. | 343/895 |
| 3,135,960 | 6/1964 | Kaiser et al. | 343/895 |
| 4,518,965 | 5/1985 | Hidaka | 343/742 |
| 4,647,937 | 3/1987 | Hidaka et al. | 343/742 |
| 4,809,008 | 2/1989 | Gunton | 343/700 MS |
| 5,198,826 | 3/1993 | Ito | 343/723 X |
| 5,220,340 | 6/1993 | Shafai | 343/895 |
| 5,313,216 | 5/1994 | Wang et al. | 343/895 |

FOREIGN PATENT DOCUMENTS

| | | | |
|---|---|---|---|
| 0064503 | 6/1981 | Japan | 343/895 |

OTHER PUBLICATIONS

Wang and Tripp, *Design Of Multioctave Spiral-Mode Microstrip Antennas, IEEEE Transactions On Antennas And Propagation*, vol. 39, No. 3, Mar. 1991, pp. 332–335.

*Primary Examiner*—Donald T. Hajec
*Assistant Examiner*—Tho Phan
*Attorney, Agent, or Firm*—Bell, Seltzer, Park & Gibson, P.A.

[57] ABSTRACT

The microstrip antenna includes a conductive ground plane and a number of conductive broken loops which extend from a first end to an opposed second end. The first ends of each of the broken loops are connected to a feedline conductor for transmitting and receiving signals. In addition, the second end of each broken loop is spaced apart from the respective first end of the broken loop to define the broken loop. Further, a layer of dielectric material, such as a printed circuit board, can be disposed between the ground plane and a plurality of broken loops. Thus, by appropriately selecting the respective lengths of the broken loops, the frequency range over which the microstrip antenna transmits and receives signals can be tuned. In addition, the microstrip antenna is relatively thin so as to be disposed flush with the surface of a mounting platform within a relatively shallow cavity. In addition, the microstrip antenna can be shaped to conform with the complexly shaped mounting platform while still providing reception and transmission over a broadband of frequencies.

16 Claims, 2 Drawing Sheets

MICROSTRIP ANTENNA HAVING A PLURALITY OF BROKEN LOOPS

FIELD OF THE INVENTION

The present invention relates generally to antennas and, more particularly, to microstrip antennas.

BACKGROUND OF THE INVENTION

Antennas are mounted on a variety of platforms to perform a variety of functions. For example, antennas are oftentimes mounted on the surface of an airplane and other air vehicle, such as a missile or a helicopter, to provide, among other functions, direction finding and communications-related functions. Due to size limitations of many mounting platforms, the size of the antenna is preferably minimized.

In addition, for antennas mounted on airplanes, the amount by which the antenna protrudes beyond the surface or skin of the aircraft is also preferably minimized so as to thereby reduce the effect of an antenna on the radar signature of the aircraft. In order to reduce the amount by which a conventional antenna extends or protrudes beyond the surface of a mounting platform, such as the surface of an airplane, conventional antennas are generally mounted in a cavity defined within the surface of the aircraft. In addition, conventional planar microstrip antennas may also be mounted in a lossy cavity in order to absorb radiation on one side of the planar antenna, thereby providing a microstrip antenna having a unidirectional pattern.

Thus, while the radiating element may only protrude slightly beyond the surface of the aircraft, a sizable cavity is oftentimes required below the surface to provide adequate antenna radiation and reception performance. In order to provide a sufficiently large cavity in which to mount the antenna, the load bearing structure of the platform, such as the aircraft, must generally be relocated or other load bearing structures must be enlarged in order to compensate for the lack of structural support within the cavity.

It is also desirable in many instances to mount an antenna on a platform which is not flat or planar, but which has a complex shape. For example, it is oftentimes desirable to mount an antenna on the leading edge of an aircraft wing, the trailing edge of an aircraft wing or the tail of an aircraft in order to optimize the performance of the antenna. However, conventional antennas are difficult to shape into the desired complex shape while maintaining the proper performance characteristics.

SUMMARY OF THE INVENTION

It is therefore an object of the present invention to provide an antenna which mounts flush with the surface of a mounting platform.

It is another object of the present invention to provide a relatively thin antenna which can be inset within a mounting platform without creating a deep cavity therein.

It is yet another object of the present invention to provide an antenna which readily conforms to complexly shaped surfaces.

These and other objects are provided, according to the present invention, by a microstrip antenna including a ground plane of conductive material and a plurality of mutually parallel broken loops of conductive material which each extend from a first end to an opposed second end and which each are electrically connected at their respective first ends. The second end of each broken loop is spaced apart from the respective first end to define the broken loop. The microstrip antenna of the present invention is adapted to transmit and receive signals having a predetermined range of wavelengths. The predetermined range of wavelengths includes a predetermined short wavelength $\lambda_S$ and a predetermined long wavelength $\lambda_L$. By appropriately selecting the lengths of the broken loops, the desired range of wavelengths can be obtained. Thus, the microstrip antenna can provide transmission and reception over a broadband of frequencies by appropriately selecting the lengths of the plurality of broken loops.

The microstrip antenna also preferably includes a feedline conductor. Consequently, the ground plane preferably includes at least one aperture extending therethrough. According to one embodiment, the feedline conductor has a first portion which extends through the aperture defined in the ground plane and a second portion, connected to the first portion, which extends parallel to the ground plane. According to another embodiment, the feedline conductor is disposed on a first side of the ground plane and is connected to the first ends of a plurality of conductive pins. The plurality of conductive pins extend through respective apertures defined in the ground plane to a second side of the ground plane, opposite the first side.

The first ends of each of the broken loops are connected, in the first embodiment, to the feedline conductor and, in the second embodiment, to the second end of a respective conductive pin. Thus, each broken loop can be connected to a common source. For example, the feedline conductor can be electrically connected to either a receiver, in a first embodiment or to a transmitter in a second embodiment. Likewise, signals transmitted by the transmitter, via the feedline conductor, can be propagated by the plurality of broken loops in the first embodiment. Accordingly, signals received by the broken loops of the microstrip antenna can be transmitted, via the feedline conductor, to the receiver in the second embodiment.

The plurality of broken loops are preferably coplanar. In addition, the plurality of broken loops are preferably concentric and, more preferably, the spacing between each of the mutually parallel broken loops is equal. Further, the broken loops are preferably spaced apart from and parallel to the ground plane.

A layer of dielectric material can be disposed between the spaced apart ground plane and the plurality of broken loops. The layer of dielectric material can also define at least one aperture therethrough which is aligned with the aperture defined on the ground plane. According to one embodiment, the layer of dielectric material includes a printed circuit board having opposed first and second major surfaces. In this embodiment, the ground plane is disposed on the first major surface and the plurality of broken loops are disposed on the second major surface. Since the antenna is fabricated on and includes a printed circuit board, the microstrip antenna of the present invention can be relatively thin and can be conformed to complexly shaped surfaces. Thus, the microstrip antenna can be mounted flush with the surface of a mounting platform, such as the surface of an aircraft, without requiring a deep cavity to be formed in the surface of the mounting platform.

In transmitting and receiving signals having a predetermined range of wavelengths, the respective lengths of the plurality of broken loops are preferably selected accordingly. For a plurality of broken loops disposed on a layer of dielectric material having a predetermined relative dielectric constant $\epsilon_r$, a first broken loop preferably has a length $L_S$ at least as small as $\lambda_S/\sqrt{\epsilon_r}$. Likewise, a second broken loop preferably has a length $L_L$ at least as large as $\lambda_L/\sqrt{\epsilon_r}$. Thus, the microstrip antenna of the present invention can transmit and receive signals within a predetermined range of frequencies. Furthermore, by appropriately selecting the respective lengths of the broken loops, the microstrip antenna of the present invention can transmit and receive signals across a broadband of frequency.

DETAILED DESCRIPTION OF THE PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete and will fully convey the scope of the invention to those skilled in the art. Like numbers refer to like elements throughout.

Figure 1:
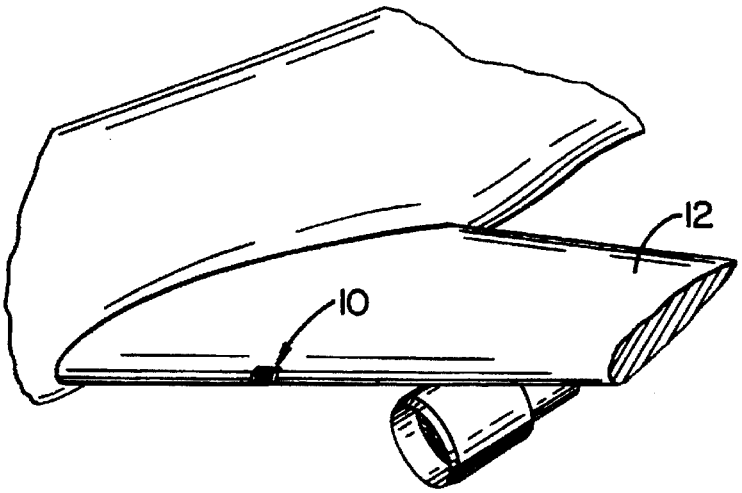
FIG. 1 is a fragmentary perspective view of a microstrip antenna according to one embodiment of the present invention illustrating the flush mounting of the microstrip antenna with the surface of a host aircraft.

Referring now to FIG. 1, a microstrip antenna 10 according to one embodiment of the present invention is illustratively mounted on an aircraft 12. In particular, the microstrip antenna is mounted flush with the surface or skin of the aircraft such that the signature of the aircraft is not compromised by the physical presence of the microstrip antenna. In addition, due to the relatively thin size of the microstrip antenna as described in detail below, the cavity in which the microstrip antenna is mounted need not be deep, but, instead, can be relatively shallow, such as ⅛ of an inch, for example.

In addition, the microstrip antenna 10 in its present invention is shown in FIG. 1 mounted on the leading edge of a wing. Consequently, the microstrip antenna has a complex shape which matches the complex shape of the leading edge of the wing. However, the microstrip antenna can be mounted on other portions of the aircraft 12 which have either a flat or a complex shape. In addition, the microstrip antenna of the present invention can be mounted on other mounting platforms without departing from the spirit and scope of the present invention. Although not illustrated, a protective film, typically comprised of polyurethane coated fiberglass which can, for example, have a thickness of 0.030 inches, can overlie the microstrip antenna to provide environmental protection.

Figure 2:
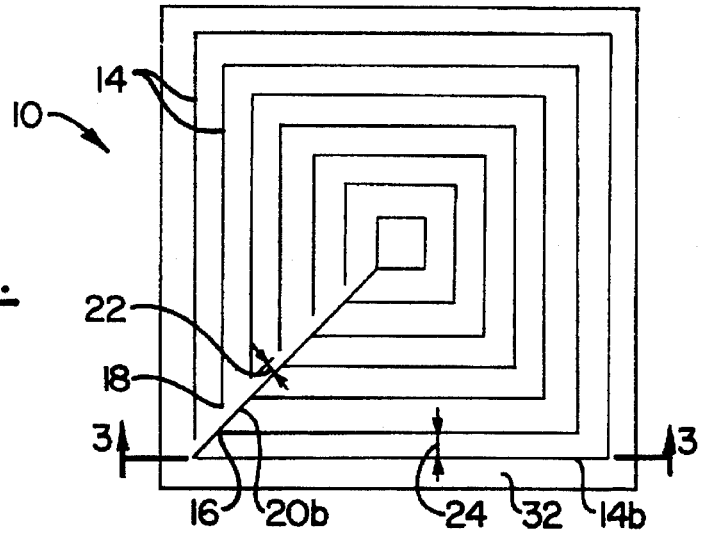
FIG. 2 is a plan view of a microstrip antenna according to a first embodiment of the present invention.

A first embodiment of the microstrip antenna 10 is shown in plan view in FIG. 2. As illustrated, the microstrip antenna includes a plurality of broken loops 14. Each broken loop is mutually parallel to the other broken loops in order to provide proper radiation and reception. Each broken loop is also preferably comprised of a conductive material, such as copper, and extends from a first end 16 to an opposed second end 18. According to the illustrated first embodiment, the respective first ends of each of the loops are connected to a feedline conductor 20. The feedline conductor is also preferably comprised of a conductive material, such as copper. As also shown, the second end of each broken loop is spaced apart from the respective first end.

As shown in FIG. 2, each broken loop 14 has the same width, such as 0.080 inch, for example. However, the widths of the plurality of broken loops can vary without departing the spirit and scope of the present invention. In addition, the spacing 22 between the respective first and second ends 16 and 18, respectively, of each of the plurality of broken loops can be equal as shown in FIG. 2, such as 0.030 inches, for example. However, the spacing between the respective first and second ends of each broken loop can also vary without departing from the spirit and scope of the present invention.

As illustrated in FIG. 2, the plurality of broken loops 14 are preferably concentric. In addition, the spacing 24 between each of the plurality of broken loops is preferably equal. For example, in one exemplary embodiment, the spacing between adjacent loops is 0.030 inches. However, the spacing between adjacent broken loops can also vary without departing from the spirit and scope of the present invention. In addition, while rectangular loops are illustrated and described herein, the mutually parallel broken loops can have a variety of shapes, such as circular, elliptical, triangular or polygonal.

Figure 3:
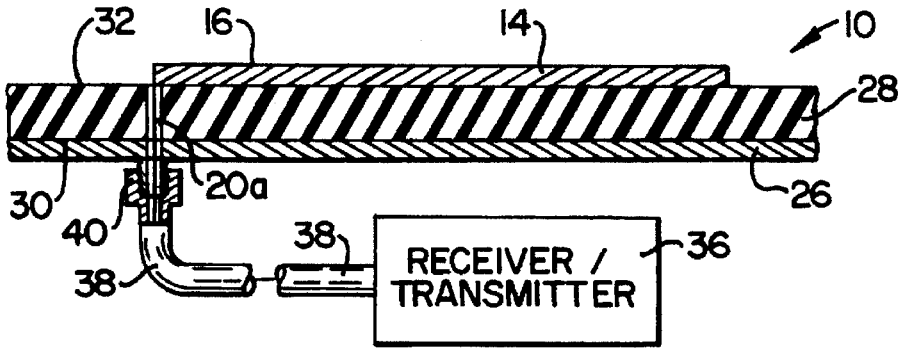
FIG. 3 is a cross-sectional view of the microstrip antenna of the first embodiment of the present invention taken along line 3—3 of FIG. 2.

As shown in cross-section in FIG. 3, the microstrip antenna 10 of the first embodiment of the present invention includes a ground plane 26 of conductive material, such as copper or aluminum. The thickness of the ground plane is typically 0.125 inches, but can be increased to provide additional structural integrity to the microstrip antenna.

The microstrip antenna 10 also includes a feedline conductor 20 having a first portion 20*a* which extends through an aperture defined the in the ground plane 26. The feedline conductor also includes a second portion 20*b*, connected to the first portion, which extends parallel to the ground plane. The feedline conductor is also comprised of a conductive material, such as copper. As shown in FIGS. 2 and 3, the second portion of the feedline conductor is connected to the first end 16 of each of the plurality of broken loops 14.

As also shown in FIG. 3, the microstrip antenna 10 can include a layer of dielectric material 28 between the ground plane 26 and the plurality of broken loops 14. In one embodiment, the dielectric layer is comprised of air. In another embodiment, the dielectric layer is comprised of a solid dielectric material, such as teflon or fiberglass, which provides an insulating layer between the ground plane and the plurality of broken loops. In the embodiment of the microstrip antenna illustrated in FIGS. 2 and 3, the dielectric material also defines at least one aperture therethrough. Preferably, the aperture defined in the layer of dielectric material is aligned with the aperture defined in the ground plane such that the first portion 20*a* of the feedline conductor 20 extends through aligned apertures defined in both the ground plane and the layer of dielectric material.

The layer of dielectric material 28 can include a printed circuit board having opposed first and second major surfaces 30 and 32, respectively. In this embodiment, the ground plane 26 is disposed on the first major surface of the printed circuit board and the plurality of broken loops 14 and the second portion 20*b* of the feedline conductor 20 are disposed on the second major surface of the printed circuit board. Accordingly, the microstrip antenna 10 of the present invention can be readily manufactured according to conventional printed circuit board manufacturing techniques. In addition, the microstrip antenna of the present invention can be relatively thin, such as ⅛ of an inch, so that the microstrip antenna can be seated within a relatively shallow cavity in the mounting platform while remaining flush with the surface of the mounting platform. Thus, both the structural integrity and original radar signature of the mounting platform, such as an aircraft 12, can be maintained.

Further, the printed circuit board can be formed in a predetermined complex shape to match the shape of the mounting platform, such as the leading edge of an aircraft, on which the microstrip antenna is installed. In particular, the printed circuit board can be formed of flexible etched circuitry which can be shaped as desired.

Figure 4:
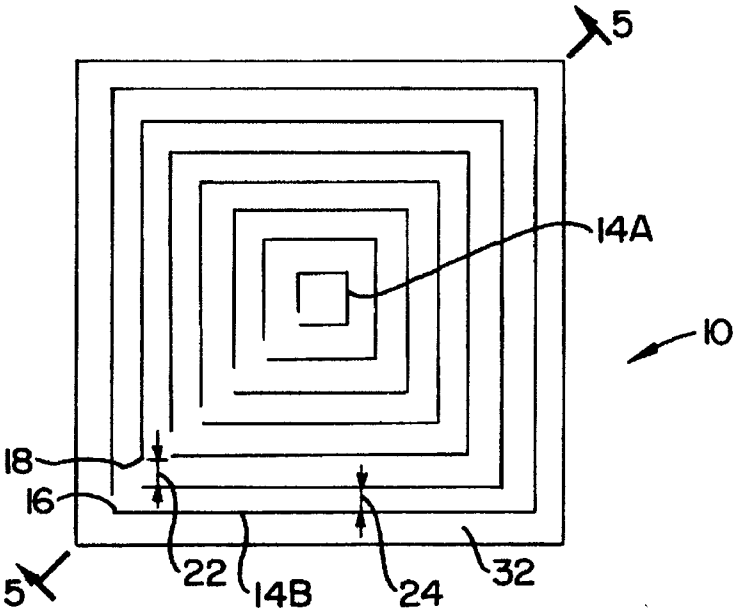
FIG. 4 is a plane view of a microstrip antenna according to a second embodiment of the present invention.
Figure 5:
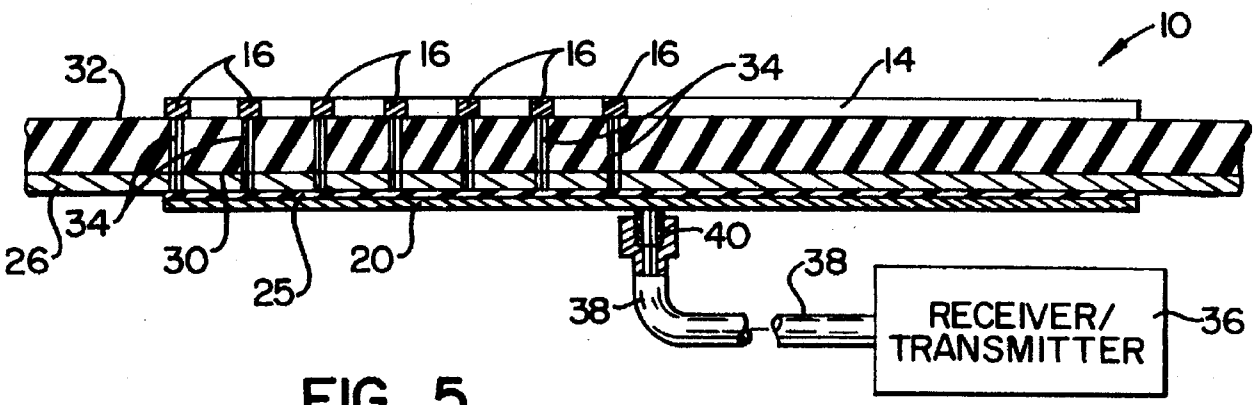
FIG. 5 is a cross-sectional view of the microstrip antenna of the second embodiment of the present invention taken along line 5—5 of FIG. 4.

A second embodiment of the microstrip antenna 10 of the present invention is illustrated in FIGS. 4 and 5. In this embodiment, the feedline conductor 20 is disposed on a first side of the ground plane 26. As shown, an insulating layer 25 preferably extends between the feedline conductor and the ground plane. A plurality of conductive pins 34, typically comprised of copper, are connected at a first end to the feedline conductor and extend through respective apertures defined in the ground plane to a second side of the ground plane, opposite the first side. The second end of each respective conductive pin preferably contacts the first end 16 of a respective broken loop 14 such that each broken loop is electrically connected with the feedline conductor. While two embodiments of a feedline conductor are illustrated and described, other methods of feeding the plurality of broken loops can be employed without departing from the spirit and scope of the present invention.

According to either illustrated embodiment of the microstrip antenna 10, the feedline conductor 20 is preferably electrically connected to a receiver or a transmitter shown as block 36 and as described below. As will be apparent to those skilled in the art, the microstrip antenna of the present invention can be employed to either transmit or receive signals. Consequently, the reception pattern of a receiving antenna is analogous to the radiation pattern of a transmitting antenna.

Consequently, the microstrip antenna 10 of one embodiment of the present invention can be configured to transmit signals. In this embodiment, the microstrip antenna includes a transmitter 36, shown schematically in FIGS. 3 and 5, which is electrically connected to the feedline conductor 20. Accordingly, the transmitter transmits signals, via the feedline conductor, to the plurality of broken loops 14 which, in turn, propagate the transmitted signals into space. Alternatively, the microstrip antenna of the present invention can be configured to receive signals. In this embodiment, a receiver (also shown as block 36) can be electrically connected to the feedline conductor for receiving signals from the plurality of broken loops. Alternatively, a transceiver can be electrically connected to the feedline conductor to provide both transmission and reception of signals by the microstrip antenna.

As shown in FIGS. 3 and 5, the transmitter or receiver 36 is generally connected to the feedline conductor 20 with a coaxial cable 38. As shown in FIGS. 3 and 5, the coaxial cable can be threadably connected to a connector 40, such as an TNC-type connector, which extends rearwardly from the ground plane 26. However, other types of connectors and other means for connecting the receiver and transmitter to the microstrip antenna can be employed without departing from the spirit and scope of the present invention.

The microstrip antenna 10 of the present invention is adapted to receive and transmit signals having a predetermined range of wavelengths. The predetermined range of wavelengths extends from a predetermined short wavelength $\lambda_S$ to a predetermined long wavelength $\lambda_L$. For example, the predetermined short wavelength $\lambda_S$ can be 1.5 inches and the predetermined long wavelength $\lambda_L$ can be 12 inches. Consequently, the microstrip antenna of the present invention can provide relatively broadband frequency performance. However, the microstrip antenna can be adapted to transmit or receive other predetermined ranges of wavelengths as described below.

In order to transmit or receive the predetermined range or wavelengths, a microstrip antenna 10 having a layer of air as the dielectric material preferably includes a first broken loop **14*a* having a length $L_S$ at least as small as the predetermined short wavelength $\lambda_S$ and a second broken loop 14*b*** having a length $L_L$ at least as large as the predetermined long wavelength $\lambda_L$. Thus, in the above example, the microstrip antenna preferably has a first broken loop having a length $L_S$ at least as short as 1.5 inches and a second broken loop having a length $L_L$ at least as long as 12 inches.

In addition, the microstrip antenna 10 preferably has a number of other broken loops 14 having lengths between the lengths of the first and second broken loops. For example, in the embodiments of the microstrip antenna illustrated in FIGS. 2 and 4, the interiormost broken loop **14*a* preferably has a length $L_S$ at least as short as the predetermined short wavelength $\lambda_S$ and the outermost broken loop 14*b*** preferably has a length $L_L$ at least as long as the predetermined long wavelength $\lambda_L$. Therefore, by appropriately selecting the lengths of the broken loops, the range of wavelengths, and, consequently, the range of frequencies, which the microstrip antenna is adapted to transmit or receive can be tuned.

The lengths L of the respective broken loops 14 can be further varied based upon the dielectric constant $\epsilon$ of the layer of dielectric material 28 on which the broken loops are disposed. In particular, the preferred lengths L of the respective loops decrease as the dielectric constant of the layer of dielectric materials increases in order to transmit and receive signals having the same wavelength. More specifically, the lengths L of the respective layers decrease by a factor of $1/\sqrt{\epsilon_r}$ wherein $\epsilon_r$ is the relative dielectric constant of the layer of dielectric material. Thus, each broken loop advantageously receives signals having a wavelength $\lambda$ of $L/\sqrt{\epsilon_r}$.

For example, in the illustrated embodiment in which the broken loops 14 are disposed on a layer of dielectric material 28 having a predetermined relative dielectric constant $\epsilon_r$, the interiormost broken loop **14*a* preferably has a length $L_S$ of $\lambda_S/\sqrt{\epsilon_r}$ wherein $\lambda_S$ is the predetermined short wavelength. Likewise, the outermost broken loop 14*b* preferably has a length $L_L$ of $\lambda_L/\sqrt{\epsilon_r}$ wherein $\lambda_L$ is the predetermined long wavelength. Consequently, by properly selecting the dielectric constant of the layer of dielectric material, the physical size of the microstrip antenna 10** can be controllably varied.

The microstrip antenna 10 of the present invention generally has a maximum gain normal to the plane defined by the plurality of broken loops 14. This maximum or peak gain is substantially isotropic across the surface of the antenna. More specifically, the microstrip antenna of the present invention preferably receives both vertically and horizontally polarized signals, as well as circularly polarized signals. In addition, the microstrip antenna of the present invention provides an advantageous voltage standing wave ratio ("VSWR") frequency range, such as 3:1 continuously over a 4:1 frequency range.

Thus, the microstrip antenna 10 of the present invention can be employed for a number of applications, such as direction finding and navigation, communications including television satellite reception and relatively low power RF and microwave transmission, and sensors for medical applications. Notwithstanding the broadband frequency performance and resulting versatility of application, the microstrip antenna of the present invention is relatively thin so as to be mounted flush with the surface of a mounting platform within a shallow cavity. In addition, the microstrip antenna of the present invention is adapted to be formed into a variety of complex shapes to replicate the shape of the mounting platform.

In the drawings and the specification, there has been set forth a preferred embodiment of the invention and, although specific terms are employed, the terms are used in a generic and descriptive sense only and not for purpose of limitation, the scope of the invention being set forth in the following claims.

What is claimed is:

1. A microstrip antenna comprising:

a ground plane of conductive material, said ground plane having opposed first and second sides and defining at least one aperture extending therethrough;

a feedline conductor having a first portion which extends through the aperture defined in said ground plane, said feedline conductor also having a second portion, connected to the first portion, which extends parallel to said ground plane on the second side thereof; and a plurality of mutually parallel broken loops disposed on the second side of said ground plane, each of said broken loops being comprised of a conductive material and extending from a first end to an opposed second end, wherein the respective first ends of each of said loops are connected to the second portion of said feedline conductor such that each of said broken loops is commonly fed by said feedline conductor, and wherein each broken loop extends about an angular region of less than 360° such that each second end is spaced apart from a respective first end.

2. A microstrip antenna according to claim 1 wherein said plurality of broken loops are coplanar, and wherein said coplanar broken loops are spaced apart from and parallel to said ground plane.

3. A microstrip antenna according to claim 1 wherein said plurality of broken loops are concentric, and wherein the spacing between each of said plurality of broken loops is equal.

4. A microstrip antenna according to claim 1 further comprising a layer of dielectric material disposed between said ground plane and said plurality of broken loops, said layer of dielectric material defining at least one aperture therethrough, wherein the aperture defined in said layer of dielectric material is aligned with the aperture defined in said ground plane, and wherein the first portion of said feedline conductor extends through the apertures defined in both said ground plane and said layer of dielectric material.

5. A microstrip antenna according to claim 4 wherein said layer of dielectric material comprises a printed circuit board having opposed first and second major surfaces, wherein said ground plane is disposed on the first major surface of said printed circuit board, and wherein said plurality of broken loops and the second portion of said feedline conductor are disposed on the second major surface of said printed circuit board.

6. A microstrip antenna according to claim 4 wherein the microstrip antenna is adapted to process signals having a predetermined range of wavelengths from a predetermined short wavelength $\lambda_S$ to a predetermined long wavelength $\lambda_L$, wherein said layer of dielectric material has a predetermined relative dielectric constant $\epsilon_r$, wherein each broken loop has a predetermined length, and wherein a first broken loop has a length at least as small as $\lambda_S/\sqrt{\epsilon_r}$ and a second broken loop has a length at least as large as $\lambda_L/\sqrt{\epsilon_r}$.

7. A microstrip antenna according to claim 1 further comprising a transmitter, electrically connected to said feedline conductor, for transmitting signals via said feedline conductor to said plurality of broken loops.

8. A microstrip antenna according to claim 1 further comprising a receiver, electrically connected to said feedline conductor, for receiving signals via said feedline conductor from said plurality of broken loops.

9. A microstrip antenna comprising:

a ground plane of conductive material, said ground plane defining a plurality of apertures extending therethrough;

a feedline conductor disposed on a first side of said ground plane;

a plurality of conductive pins connected at a first end to said feedline conductor and extending through respective apertures defined in said ground plane to a second side of said ground plane, opposite the first side; and a plurality of mutually parallel broken loops disposed on the second side of said ground plane, each of said broken loops being comprised of a conductive material and extending from a first end to an opposed second end, wherein the first ends of each of said loops are connected to a second end of a respective conductive pin such that each of said broken loops is electrically connected to and commonly fed by said feedline conductor, wherein each broken loop extends about an angular region of less than 360° such that each second end is spaced apart from a respective first end, and wherein each broken loop has a predetermined length selected such that the microstrip antenna can operate over a broad range of wavelengths from a predetermined short wavelength $\lambda_S$ to a predetermined long wavelength $\lambda_L$.

10. A microstrip antenna according to claim 9 wherein said plurality of broken loops are coplanar, and wherein said coplanar broken loops are parallel to said ground plane.

11. A microstrip antenna according to claim 9 wherein said plurality of broken loops are concentric, and wherein the spacing between each of said plurality of broken loops is equal.

12. A microstrip antenna according to claim 9 further comprising a layer of dielectric material disposed between said ground plane and said plurality of broken loops, said layer of dielectric material defining a plurality of apertures therethrough, wherein each aperture defined in said layer of dielectric material is aligned with a respective aperture defined in said ground plane, and wherein said plurality of conductive pins extend through respective apertures defined in both said ground plane and said layer of dielectric material.

13. A microstrip antenna according to claim 12 wherein said layer of dielectric material comprises a printed circuit board having opposed first and second major surfaces, wherein said ground plane is disposed on the first major surface of said printed circuit board, and wherein said plurality of broken loops are disposed on the second major surface of said printed circuit board.

14. A microstrip antenna according to claim 12 wherein the microstrip antenna is adapted to process signals having a predetermined range of wavelengths from a predetermined short wavelength $\lambda_S$ to a predetermined long wavelength $\lambda_L$, wherein said layer of dielectric material has a relative predetermined dielectric constant $\epsilon_r$, wherein each broken loop has a predetermined length, and wherein a first broken loop has a length at least as small as $\lambda_S/\sqrt{\epsilon_r}$ and a second broken loop has a length at least as large as $\lambda_L/\sqrt{\epsilon_r}$.

15. A microstrip antenna according to claim 9 further comprising a transmitter, electrically connected to said feedline conductor, for transmitting signals via said feedline conductor and said plurality of conductive pins to said plurality of broken loops.

16. A microstrip antenna according to claim 9 further comprising a receiver, electrically connected to said feedline conductor, for receiving signals via said feedline conductor and said plurality of conductive pins from said plurality of broken loops.

* * * * *